United States Patent [19]

Llewellyn

[11] Patent Number: 4,748,993

[45] Date of Patent: Jun. 7, 1988

[54] RACK FOR HOLDING NIPPLES IN A DISHWASHER

[76] Inventor: Scott Llewellyn, 19240 Olympia St., Northridge, Calif. 91326

[21] Appl. No.: 107,250

[22] Filed: Oct. 9, 1987

Related U.S. Application Data

[63] Continuation of Ser. No. 792,453, Oct. 29, 1985, abandoned.

[51] Int. Cl.[4] ..... B08B 3/02

[52] U.S. Cl. ..... 134/166 R; 134/201; 134/135; 422/297; 422/300; 211/181; 211/89

[58] Field of Search ..... 134/115, 135, 166 R, 134/201; 211/181, 89, 41; 422/297, 300

[56] References Cited

U.S. PATENT DOCUMENTS

| | | | |
|---|---|---|---|
| 612,625 | 10/1898 | Decker | 422/300 |
| 1,344,252 | 6/1920 | Baenr | 422/300 X |
| 1,608,283 | 11/1926 | Woolsey | 422/300 |
| 1,618,622 | 2/1927 | Woolsey | 422/300 X |
| 3,612,285 | 10/1971 | Mason | 211/41 |
| 4,498,594 | 2/1985 | Elder | 211/181 |
| 4,544,529 | 10/1985 | Hoeck . | |

*Primary Examiner*—Harvey C. Hornsby
*Assistant Examiner*—Frankie L. Stinson
*Attorney, Agent, or Firm*—Elliott N. Kramsky

[57] ABSTRACT

A dishwasher nipple rack for holding baby bottle nipples has a base on which the bottom of the nipples rests. The base has enough openings under each nipple so that water can enter and clean the nipples. Nipple hold-down members are spaced above the base and contact the upper portion of the nipple to limit the freedom of movement of the nipples. In one embodiment, the hold-down members are parallel arms. One end of the hold-down members pivot on one end of the base and the other end of the hold-down members locks to the other side of the base.

10 Claims, 2 Drawing Sheets

FIG. 1
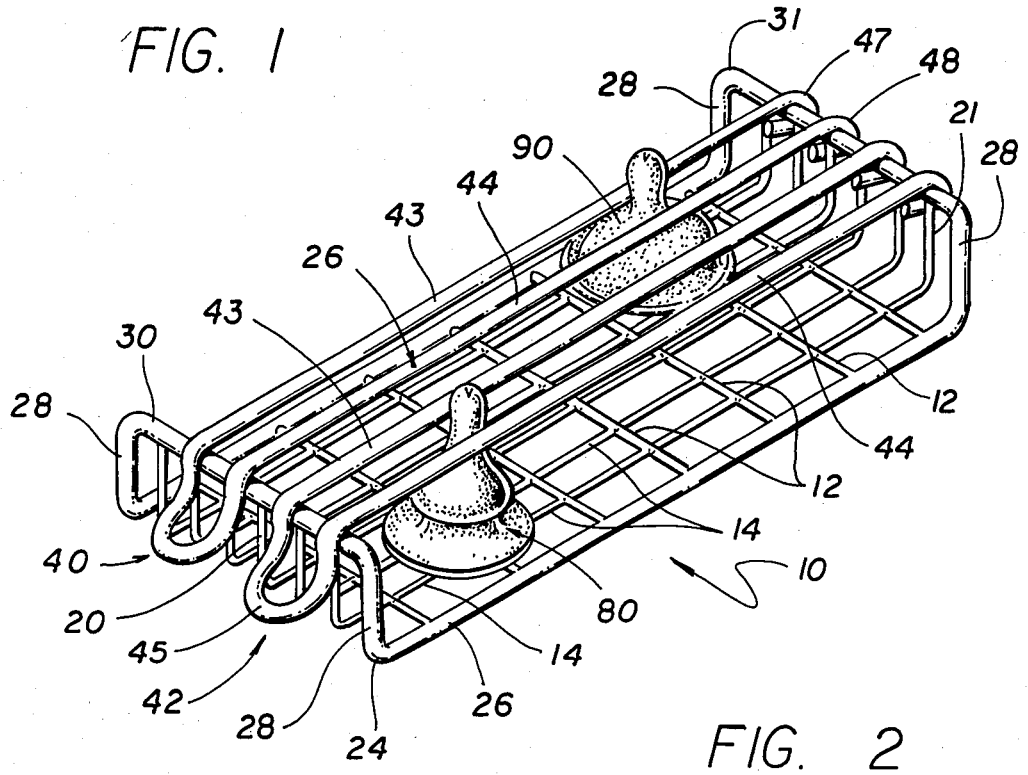
FIG. 2
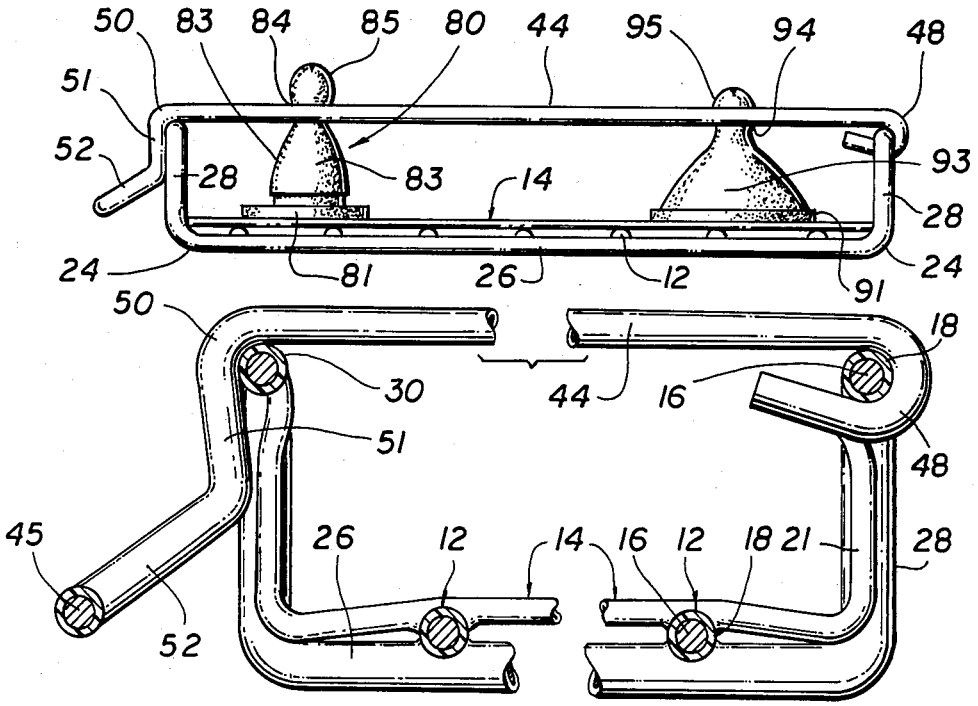
FIG. 3

FIG. 4
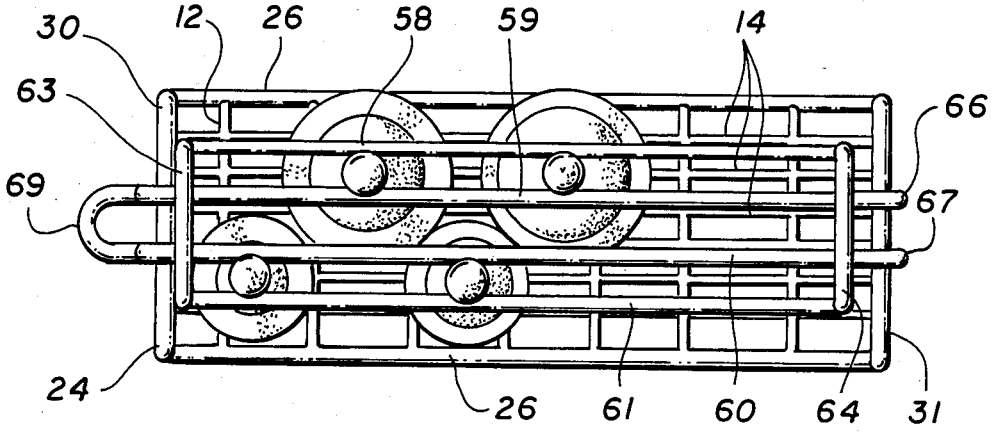
FIG. 5
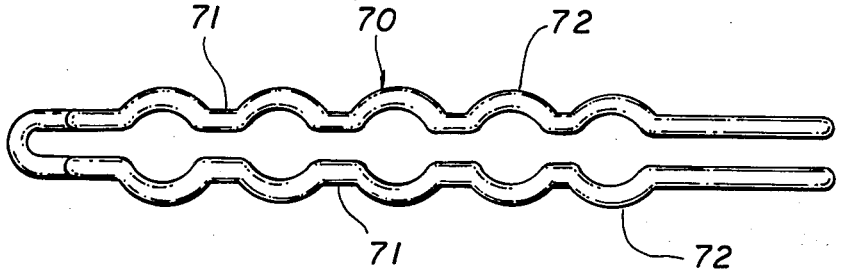
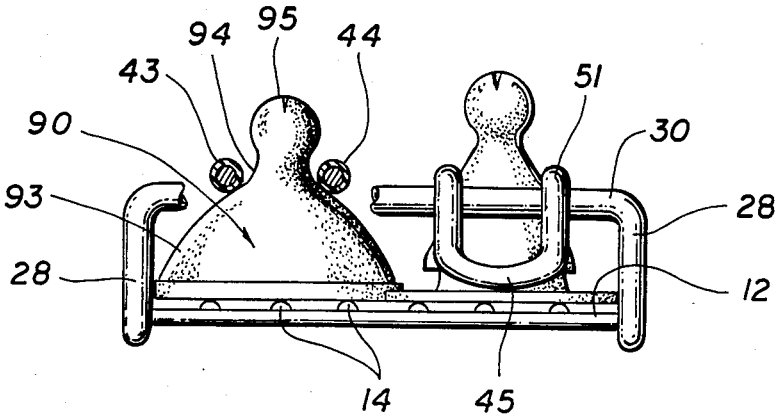
FIG. 6

RACK FOR HOLDING NIPPLES IN A DISHWASHER

This is a continuation of the U.S. patent application, Ser. No. 792,453, which was filed on Oct. 29, 1985, for a RACK FOR HOLDING NIPPLES IN A DISHWASHER and now abandoned.

BACKGROUND OF THE INVENTION

1. Field of the Invention

This invention relates to a rack for holding baby bottles nipples when they are being washed in a dishwasher.

2. The Prior Art

Nipples for baby bottles must be thoroughly washed after use. They may be boiled to sterilize them. An automatic dishwasher uses much higher temperature water then one could use hand washing the nipples, and the higher temperature of a dishwasher is thought to provide sufficient sterilization of the nipples. Nipples washed in a dishwasher do not have to be boiled separately. Before dishwashers were used, glass baby bottles themselves were usually boiled after hand washing, and the nipples were boiled with the bottles. Glass and more permanent plastic baby bottles are washed in dishwashers today. Many baby bottles use disposable inserts for holding the formula so that the bottle itself does not have to be washed. Washing the nipples separately and then boiling them is inconvenient.

Washing nipples in a dishwasher has been a problem. They are extremely light, and the force of water from the dishwasher jets moves the nipples within the conventional dishwasher rack and turns them over where they fill with water. Effective cleaning stops when the nipple is full of water. Water does not drain so the nipple retains a detergent residue, which is unhealthy for an infant. A nipple may also drop from the rack near the heating element of the dishwasher which could cause it to be damaged.

As a result, nipples are usually not washed in a dishwasher. A nipple bag has been marketed. It is formed of mesh, and nipples are placed in it. The bag does not keep the nipples upright. There have been attempts to make nipple holders for dishwashers. A prior art one has a base with a bottom opening. Two inverted L-shaped brackets extend upward from the base adjacent the opening. The base of the nipple is placed on the base of the rack, and the flange of the nipple is inserted under the L-shaped bracket. The major drawback of this system is that it works with only one size nipple, but there are many different sizes in use today. Nipples range in size from those in which a flange of the nipple is held by a threaded ring over the narrowed top of the bottle. The widest nipples are typically used with disposable bottles. Most have a bottom flange, but some older ones have no flange. The various sizes and shapes makes it extremely difficult to provide a base with openings to accommodate the different size nipples.

Some dishwashers also have small, covered racks for holding small items that do not fit on the shelves or in the silverware tray of a dishwasher or which might move under the force of the spray. Most could not hold the nipple upright even though they are acceptable for holding items in which it is not necessary that they be maintained vertically.

SUMMARY OF THE INVENTION

It is an object of the present invention to disclose and provide a dishwasher nipple rack for holding baby bottle nipples that can accommodate different sized nipples, in which nipples can be inserted and removed quickly, which is rugged and will withstand repeated use in the environment of an operating dishwasher, and which can be built with low cost.

The dishwasher nipple rack of the present invention has a generally open base for supporting the bottom of a nipple. The open structure of the base, which in one embodiment comprise spaced-apart, crisscrossing rods, allows water in the dishwasher to enter the bottom of the nipple and clean its inside. Hold-down means, which in one embodiment are in the form of two parallel rods, extend around the upper portion of the nipple to prevent the nipple from moving substantially off the base of the rack when the spray of the dishwasher water hits the nipple. The hold-down means is attached to the base such that it is spaced from the base. At least one end of the hold-down means can be removed from its position over the base to release the nipples and allow others to be placed on the base.

BRIEF DESCRIPTION OF THE DRAWINGS

FIG. 1 is the perspective view of the dishwasher rack of the present invention shown with two baby bottle nipples mounted on the rack.

FIG. 2 is a front view of the dishwasher nipple rack of the present invention.

FIG. 3 is a sectional end view of the nipple rack of the present invention.

FIG. 4 is a plan view of an alternate embodiment of the nipple rack of the present invention.

FIG. 5 is a plan view of an alternate embodiment of the hold-down means of the present invention.

FIG. 6 is a end view of the nipple rack of the present invention showing nipples being held in position on the base.

DETAILED DESCRIPTION OF THE PREFERRED EMBODIMENT

The dishwasher nipple rack of the present invention has a generally open base for supporting the bottom of a nipple and permitting dishwasher water to enter the nipple through the base. In the exemplary embodiment, base 10 is formed of crisscrossing, generally rigid, vinyl-coated rods 12 and 14. Rods 12 are generally straight. Rods 14 have ends 20 and 21 bent upward (FIGS. 1 and 3). The configuration of the base must be such that water can pass through it into the nipple. The rods (and other parts) may be formed of other materials, (e.g. plastic as long as the materials are not subject to corrosion in the dishwasher.) In the exemplary embodiment, the rods have an inner metal core 16 (FIG. 3) and a vinyl or other plastic coating 18.

Outer rack support 24 is formed of a thicker rod than rods 12 and 14. It extends at 26 in the front and back of the rack at approximately the same level as crisscrossing rods 12 and 14. The ends of front 26 of the rack extends upward at 28 (FIGS. 1, 2, 3 and 6). Ends 30 and 31 of outer rack support 24 are above rods 12 and 14 so that outer rack support 24 has the shape shown in the drawings. The crisscrossing rods 12 and 14 attach to outer rack support 24 as shown. No metal of any rods is exposed.

The rack of the present invention accommodates many different sizes of nipples. The two nipples 80 and 90 (FIGS. 1 and 2) are representative, but there are many other designs and sizes (see FIG. 4). Flange 82 of nipple 80 extends from the bottom 81 of the nipple. The bottom rests on top of a baby bottle, and a lock ring fits over nipple 80, grips the top of flange 82 and secures the nipple to the bottle. From the bottom, the walls of the nipple taper inwardly at 83 to a minimum-diameter section 84. Tip 85 extends up at the top of the nipple.

Nipple 90 is representative of one of the nipples that has been used on bottles with disposable inserts. There is no flange extending around bottom 91 of nipple 90. Rather, the nipple material is stretched around both the outside of the permanent part of the bottle and the top of the disposable insert. The nipple secures the insert to the non-disposable part of the bottle. Nipple 90 curves inward from bottom 91 along wall 93 to a minimum diameter portion at 94, and the tip 95 extends upward from there.

The present invention includes nipple hold-down means in proximity to the upper portion of the nipple above base 10 of the nipple rack. In one exemplary embodiment (FIGS. 1, 2, 3 and 6), the nipples hold-down means comprises two hold-down members 40 and 42, each of which has two generally parallel arms 43 and 44 extending from a U-shaped portion 45. The other ends 47 and 48 of arms 30 and 34 are looped over end 31 of outer rack support 24 to secure hold-down members 40 and 42 to the end. The arms are thus spaced above base 10.

Instead of having portions 28 bent upward to raise hold-down members 40 and 42 above the base, ends 30 and 31 could be in the same plane as the crisscrossing members 12 and 14. Base 10 is then flat. The ends of hold-down members 40 and 42 are bent down to reach the end of the base. Thus, the hold-down members 40 and 42 can be raised above the base by bending the ends of the base upward or by bending the ends of the hold-down members downward. If desired, a combination of these two methods can also be employed. For purposes of further discussion, however, it is assumed that the ends of base 10 are bent upward.

U-shaped ends 45 of hold-down members 40 and 42 are bent downward at curved portions 50 over end 30 of outer support 24 (FIGS. 2 and 3), and depending portions 51 below curved portion so each make slightly acute angle to arms 43 and 44. When arms 43 and 44 of hold-down members 40 and 42 are pivoted to the position shown in FIGS. 1 through 3, portions 51 tend to secure the arms to end 30. To release either of the arms, one can push upward on handle portions 52. The wire material of the hold-down members yields slightly and allows one to lift portion 51 over end 30 so that hold-down members 40 and 42 can be pivoted upward.

Arms 43 and 44 are spaced apart at a distance such that both are in close proximity to or in contact with upper parts of the nipple. The spacing of the arms will accommodate different size nipples. If part of a nipple contacts the arms 43 and 44, no problems are created because the nipple is flexible enough to give. If the arms are not in contact with the nipple, the nipple has some small freedom of movement. When the jets of water push the nipple upward, arms 43 and 44 make contact with the nipple. There is not enough freedom of movement so that the nipple can move out of the rack or turn over.

Some of the variations in the hold-down members are shown in FIGS. 4 and 5. In FIG. 4, hold-down member 56 is a single member having four longitudinal arms 58, 59, 60 and 61 extending over the base in a similar fashion to the way arms 43 and 44 extend in FIG. 1. Instead of having two pairs of independent arms freely pivotable with respect to each other, arms 58–61 are fixed together by cross-arms 63, 64. Only two pivots 66 and 67 and a single locking portion 69 are needed. They extend from the central longitudinal arms 59 and 60.

The use of the alternative embodiment dishwasher nipple rack of FIG. 4 is similar to that in the previously discussed embodiments. The nipples are placed on base 10 when the hold-down member 56 is pivoted upward, away from the base. When the nipples are placed on the base, hold-down member 56 is pivoted to the position shown in FIG. 4 with the upper portion of the nipple extending between adjacent arms.

Rather than having arms 58 an 61 pivot with arms 59 and 60 in the FIG. 4 embodiment, there can be horizontal arms fixed above the base. The nipples can be placed against these outside arms, and a central arm can come down and trap the nipple between the central arms and the outside arms.

The adjacent arms of the hold-down members of the various embodiments are designed to restrict the freedom of movement of the nipples. There are several other ways of providing the limited movement. One alternative (FIG. 5) has arms 70 and 71 with curved receiving portions 72, which provide a fixed position for each nipple. As shown in FIG. 4 (the first embodiment), nipples might be staggered along base 10 to allow more to fit on the base. Fixing their position with curved portions 72 may eliminate this advantage.

The hold-down means may be modified as long as the degrees of movement of the nipple are sufficiently limited so that the nipple does not turn over when water strikes it. For example, rather than having two, vinyl-coated wire arms, a generally flat, plastic arm with openings for receiving the top of the nipple can be used. A single plastic piece with spaced horizontal loops for receiving the nipple may also be used. Another suggestion is to have a vinyl coated wire with spaced, bent, looped sections. Many other designs for the hold-down members are also possible.

An important design criterion for the hold-down means is that it must prevent the nipples from tipping over. FIG. 6 best shows the relationship of the arms 43 and 44 to the nipple. The arms prevent the nipple from moving upward too much. Likewise, the arms prevent the nipple from pivoting to the side. If the nipple tries to pivot forward or backward, tip 95 contacts the arms, and the nipple cannot tip over.

Both ends of hold-down members 40 and 42 (FIGS. 1–3) could be removable from the base if desired, but by having ends 47 and 48 looped over and end 31 of the support 24, the hold-down members stay with the rest of the dishwasher nipple rack.

The dimensions of the dishwasher nipple rack can be modified. It is not necessary the the rack be wide enough for two nipples to be side-by-side next to each other; the outside of the nipples can extend over sides 26. The dishwasher nipple rack should be made long enough to accommodate a day's use of nipples.

When the dishwasher nipple rack is fully loaded and hold-down members 40 and 42 lock the nipples in place, the rack is then placed in a dishwasher such that the nipples extend upward. The rack holds the nipples in place during the wash rinse and drying cycles of the dishwasher. When the dishwasher finishes its cycles, the rack can be removed and the nipples removed from the rack. The dishwasher nipple rack of the present invention could also be mounted permanently on one of the roll-out racks of the dishwasher.

Various modifications and changes may be made in the configuration described above that come within the spirit of this invention. The invention embraces all such changes and modifications coming within the scope of the appended claims.

I claim:

1. A rack for holding bottle nipples of various types and sizes, against the force of a stream of water within a functioning automatic dishwasher, each one of the nipples having an open bottom portion tapering to an upper portion that generally forms a reduced-diameter neck portion and an upper generally round tip portion, the rack comprising, in combination:

(a) a generally open base for supporting the bottom portion of each nipple, and for permitting dishwasher water to enter each nipple through its open bottom portion in an upright generally vertical direction, for an effective cleaning of the nipple;

(b) said open base including a substantially planar central portion formed of a plurality of spaced-apart rods, said rods being arranged for seating different size nipples, and for positioning the nipples in a stable substantially upright position;

(c) means for holding down the nipples including a substantially planar central portion supported releasably to said base, whereby, in a first position, said planar central portions of said base and of the nipple hold-down means are substantially parallel and separated by a distance that is less than the height of the nipples for restraining the upward movement thereof;

(d) the nipple hold-down means defining an elongated spacing dimensioned and adapted to receive closely, serially the upper portions of the nipples when the nipple hold-down means is in the first position;

(e) said spacing extending in close proximity to the reduced-diameter neck portions of the nipples, for limiting their lateral movement; and (f) means for engaging the nipple hold-down means to said base.

2. The rack as defined in claim 1 wherein said base further includes turned up portions for engaging releasably the nipple hold-down means.

3. The rack as defined in claim 1 wherein the nipple hold-down means includes at least one substantially parallel pair of elongated spaced-apart arms for defining said elongated spacing, each arm being disposed on an opposite side of each nipple.

4. The rack as defined in claim 3 wherein said arms include a connection portion at one end of the arms for attaching the arms together.

5. The rack as defined in claim 3 wherein each one of the arms has at least one opposing curved section for extending at least partially around each nipple.

6. The rack as defined in claim 1 wherein the nipple hold-down means includes two pairs of substantially parallel elongated spaced-apart arms, each arm being disposed on an opposite side of each nipple.

7. The rack as defined in claim 6 further including securing means extending between each pair of arms for securing the pairs of arms together.

8. The rack as defined in claim 1 wherein said rods are disposed in a matrix arrangement for defining substantially rectangular openings therebetween.

9. A rack as defined in claim 1 wherein said means for engaging includes means for pivotally joining the nipple hold-down means to said base, whereby the nipple hold-down means is movable between the first position and a second position, for permitting the insertion and removal of nipples.

10. A rack as defined in claim 1 wherein said rods are formed of elastomeric material encapsulated wire.

* * * * *